US007228911B2

(12) United States Patent
Burge et al.

(10) Patent No.: US 7,228,911 B2
(45) Date of Patent: Jun. 12, 2007

(54) APPARATUS FOR AND METHOD OF RADIAL EXPANSION OF A TUBULAR MEMBER

(75) Inventors: Philip Michael Burge, Westhill (GB); Andrew Warnock Dobson, North Cults (GB)

(73) Assignee: e2Tech Limited, Houston, TX (US)

( * ) Notice: Subject to any disclaimer, the term of this patent is extended or adjusted under 35 U.S.C. 154(b) by 332 days.

(21) Appl. No.: 10/482,238

(22) PCT Filed: May 9, 2002

(86) PCT No.: PCT/GB02/02171

§ 371 (c)(1),
(2), (4) Date: Aug. 2, 2004

(87) PCT Pub. No.: WO02/090713

PCT Pub. Date: Nov. 14, 2002

(65) Prior Publication Data

US 2004/0256111 A1 Dec. 23, 2004

(30) Foreign Application Priority Data

May 9, 2001 (GB) ..... 0111413.1

(51) Int. Cl.
*E21B 43/10* (2006.01)

(52) U.S. Cl. ..... 166/380; 166/207; 166/384

(58) Field of Classification Search ..... 166/206
See application file for complete search history.

(56) References Cited

U.S. PATENT DOCUMENTS

| | | | | |
|---|---|---|---|---|
| 3,203,483 | A | 8/1965 | Vincent | 166/207 |
| 3,245,471 | A | 4/1966 | Howard | 166/46 |
| 3,785,193 | A * | 1/1974 | Kinley et al. | 72/393 |
| 5,560,624 | A * | 10/1996 | Williams et al. | 279/2.03 |
| 6,425,444 | B1 | 7/2002 | Metcalfe et al. | 166/387 |
| 6,457,532 | B1 | 10/2002 | Simpson | 166/380 |
| 7,028,770 | B2 * | 4/2006 | Smith et al. | 166/206 |
| 2001/0045284 | A1 | 11/2001 | Simpson et al. | |

FOREIGN PATENT DOCUMENTS

| | | |
|---|---|---|
| WO | WO 99/35368 | 7/1999 |
| WO | WO 00/37766 | 6/2000 |
| WO | WO 01/18355 | 3/2001 |
| WO | WO 01/33037 | 5/2001 |

OTHER PUBLICATIONS

PCT International Search Report from International Publication No. WO 02/090713, Application No. PCT/GB02/02171, dated Aug. 14, 2002.

* cited by examiner

*Primary Examiner*—Frank Tsay
(74) *Attorney, Agent, or Firm*—Patterson & Sheridan, L.L.P.

(57) ABSTRACT

Apparatus for and method of radial expansion of a tubular member, with embodiments of the apparatus including an expander device, for example an expansion cone, which has a driver device either attached to it or integral therewith. The driver device can be a pump for example, where the pump creates a differential pressure across the expander device to cause it to move.

23 Claims, 4 Drawing Sheets

APPARATUS FOR AND METHOD OF RADIAL EXPANSION OF A TUBULAR MEMBER

CROSS-REFERENCE TO RELATED APPLICATIONS

This application claims benefit of PCT International application number PCT/GB02/02171 filed on May 9, 2002, entitled "Apparatus for and Method of Radial Expansion of a Tubular Member," which claims benefit of British application serial number 0111413.1, filed on May 9, 2001.

BACKGROUND OF THE INVENTION

1. Field of the Invention

The present invention relates to apparatus and a method particularly for the radial expansion of tubular members.

2. Description of the Related Art

Conventionally, tubular members can be expanded using mechanical or other devices and methods where an expander device (e.g. a cone) is pushed or pulled through the tubular member to impart a radial plastic and/or elastic deformation to the member to increase its outer diameter (OD) and inner diameter (ID). Alternatively, the cone may be forced through the tubular member using hydraulic pressure. The tubular member is optionally at least temporarily anchored and the expander device is pushed or pulled through the tubular member to impart the radial expansion force.

There are a number of problems associated with so-called "bottom-up" expansion. The portions of the tubular member that have been expanded below the cone may be in tension or compression during the expansion process depending upon the location of the temporary anchor (where used). Thus, during hydraulic expansion of the tubular member for example, the member is in a state of tension while also under hydraulic pressure. Also, in the event of problems with the expansion, the cone can potentially become stuck as it is being pushed or pulled through the expandable member, and this may require a fishing operation to retrieve the stuck cone.

Additionally, conventional methods typically require a rig so that the expander device can be pushed or pulled through the tubular member using a wireline, drill string, coiled tubing string or the like.

SUMMARY OF THE INVENTION

According to a first aspect of the present invention, there is provided apparatus for radially expanding a tubular member, the apparatus comprising an expander device and a drive means for the expander device, the drive means being capable of moving with the expander device.

According to a second aspect of the present invention, there is provided apparatus for radially expanding a tubular member, the apparatus comprising an expander device and a drive means for the expander device, the drive means being capable of entering the tubular member and moving the expander device.

According to a third aspect of the present invention, there is provided a method of radially expanding a tubular member, the method comprising the steps of providing an expander device and a drive means, locating the device and drive means in the tubular member, and actuating the drive means to radially expand the member.

The invention also provides apparatus for expanding a tubular member, comprising an expander device having an integral drive means for moving the device within the tubular member.

The expander device is preferably an expansion cone.

The drive means typically comprises a pump. The pump is typically attached to the expansion cone (e.g. by a shaft or the like) but can be integral therewith. For example, the expansion cone can be provided with a longitudinal through-bore in which the pump can be located.

The pump is typically used to create a differential pressure across the expansion cone. The differential pressure across the cone typically causes it to move towards an area of lower pressure. The pump typically draws fluid from one side of the expansion cone to the other, thus causing the area of lower pressure. The pump can be of any conventional type, and can be, for example electric- or hydraulic-driven. This has the advantage that only an electric cable is required from the surface, and in certain embodiments this is not required (e.g. where the pump is hydraulically-driven). Where the pump is electric-driven, no rig or the like is generally required to push or pull the expander device.

A turbine can be used to provide power for the pump. The turbine is typically fluid-driven (e.g. hydraulically-driven).

The tubular member is optionally at least temporarily anchored at an end thereof at least during radial expansion of the member. A mechanical slip or packer can be used as an anchor.

The tubular member is typically located in a second conduit before radial expansion. The second conduit may comprise a borehole, casing, liner or other downhole tubular.

The tubular member can be any downhole tubular that is capable of plastic and/or elastic deformation.

The tubular member is typically of steel or a steel alloy (e.g. nickel alloy). The tubular member is typically of a ductile material.

The tubular member can be a discrete length of downhole tubular, or can be a string of downhole tubulars that are coupled together (e.g. by welding, screw threads etc).

The expansion cone can be of any conventional type. The expansion cone is typically of a material that is harder than the tubular member that is has to expand. The expansion cone may be of ceramic, steel, steel alloy, tungsten carbide or a combination of these materials. It will be noted that only the portions of the expansion cone that come into contact with the tubular to be expanded need be coated or otherwise covered with the harder material.

The method typically includes the additional step of locating the tubular member in a second conduit.

The method optionally includes the additional step of temporarily anchoring an end of the tubular member.

The step of actuating the drive means typically comprises applying power to the pump. Alternatively, the step of actuating the drive means may comprise applying power to the turbine.

BRIEF DESCRIPTION OF THE DRAWINGS

Embodiments of the present invention shall now be described, by way of example only, with reference to the accompanying drawings in which.

DETAILED DESCRIPTION OF THE PREFERRED EMBODIMENT

Figure 1:
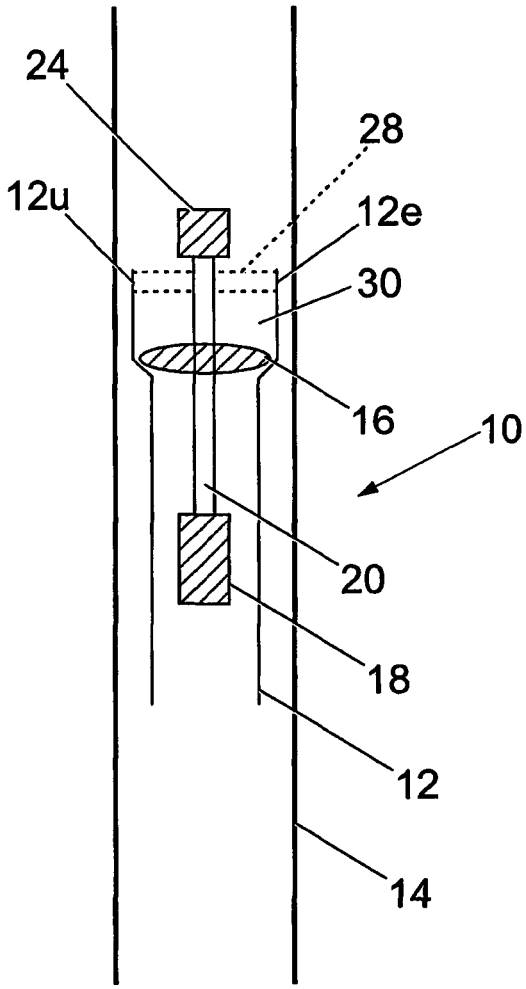
FIG. 1 is a schematic representation of an embodiment of apparatus that is being run into a casing.

Referring to the drawings, FIG. 1 shows an exemplary embodiment of apparatus 10 for the expansion of a tubular member. Apparatus 10 as shown in FIG. 1 is typically located within a portion of a downhole tubular member 12 that is to be radially expanded within a pre-installed portion of casing 14. The tubular member 12 can be any downhole tubular such as a casing, liner or the like and is typically of a ductile material that is capable of plastic and/or elastic deformation. The tubular 12 is typically of steel or an alloy of steel (e.g. nickel alloy), but other materials may be used. The pre-installed casing 14 may be any conventional downhole tubular such as casing, liner, drill pipe etc, and indeed could be an open borehole that is to be cased and/or lined.

Apparatus 10 includes an expansion cone 16 that is typically located in a pre-expanded portion 12*e* of the tubular 12 as the apparatus 10 is run in. The expansion cone 16 has a pump 18 attached thereto e.g. by a shaft 20. Expansion cone 16 may be of any conventional type, but is typically of a material that is harder than the material of the tubular member that it has to expand. The cone 16 can be, for example, of ceramic, steel, a steel alloy or tungsten carbide etc. It may only be necessary to coat or otherwise cover the portions of the cone 16 that come into contact with the tubular 12 during expansion with a harder material.

Apparatus 10 is typically located within the tubular 12 at the surface. In particular, the expansion cone 16 is typically located within the pre-expanded portion 12*e* of the tubular 12 at the surface. Thereafter, the apparatus 10 and the tubular 12 are run into the borehole to the position within casing 14 at which the tubular 12 is to be radially expanded.

Figure 5:
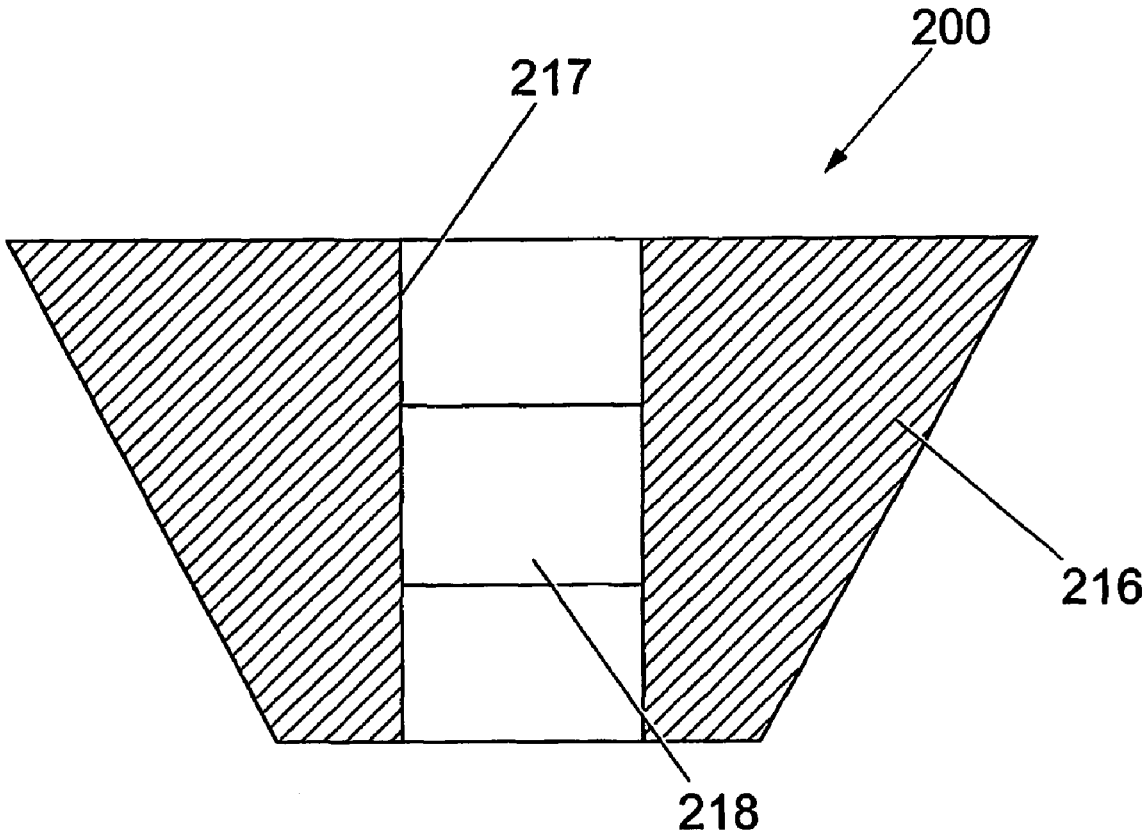
FIG. 5 shows an alternative embodiment of apparatus for radial expansion of a tubular member.

The pump 18 can be of any conventional type, e.g. electrically- or hydraulically-driven. It will be appreciated that the pump 18 may be incorporated within the expansion cone 16 itself. For example, and with reference to FIG. 5 showing an alternative embodiment of apparatus 200, the cone 216 can be provided with a throughbore 217 in which the pump 218 can be located. This would be particularly advantageous as the apparatus 200 can be made smaller and more compact.

The pump 18 is typically an electrical submersible pump (ESP) that includes a pump driven by an electric motor. Thus, an electrical cable (not shown) is typically provided from the surface and coupled to the motor of the pump 18 to drive it. Having the pump 18 driven by electricity has advantages in that only the electrical cable from the surface is required. Thus, a rig or the like is not generally required and the operation of the apparatus 10 can be autonomous in that very little user intervention, if any, is required.

The electrical cable can form part of an umbilical cable or wireline that can be attached to apparatus 10. The umbilical or wireline has advantages in that the apparatus 10 can be more easily retrieved from the borehole once the tubular 12 has been radially expanded, or if the apparatus 10 becomes stuck due to a protrusion or restriction in its path.

Alternatively, the pump 18 can be driven by a turbine 24 that is typically located above the cone 16. The turbine 24 is typically hydraulically-driven, and the apparatus 10 is typically attached to a coiled tubing string, drill string or the like through which fluids may be pumped to drive the turbine 24. This would generally require the use of a rig and may be useful where a rig is already in place and available.

Figure 2:
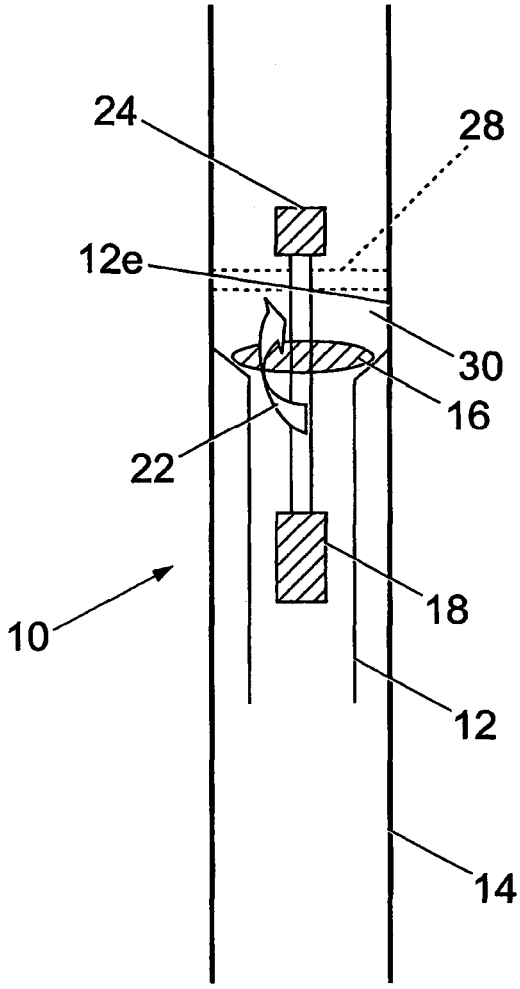
FIG. 2 is a schematic representation of the apparatus of FIG. 1 in use.

Although the turbine 24 has been shown in FIGS. 1 and 2, it will be appreciated that it will not be required where the pump 18 is electrically-driven; all that will be required is a power cable to the motor of the pump 18.

The purpose of the pump 18 is to draw fluids from below to above the cone 16 (as indicated by arrow 22 in FIG. 2), thereby creating a pressure differential across the cone 16, which causes the cone 16 to move downwards through the tubular 12, thus deforming and radially expanding it. This is because the pump 18 creates an area of high pressure above the cone 16 and an area of lower pressure below it. Thus, the cone 16 will be moved by the pressure differential across it.

The pump 18 is typically mounted at a short distance below the cone 16. The shaft 20 typically comprises of two concentric conduits. An inner conduit (not shown) would either house the drive shaft from the turbine 24 to the pump 18; carry hydraulic fluid from the surface (through a suitable string) to the turbine where it is mounted below the cone 16 and adjacent the pump 18; or to carry the electric cable 26 to take power to the pump 18. An outer conduit is typically used as a conduit for the pressurised fluid that is pumped from below the cone 16 to above it. One or more ports would be provided in the cone 16 at the termination of the outer conduit to allow fluid to be pumped above the cone 16.

The radial expansion of the tubular 12 typically causes an outer surface thereof to contact an inner surface of the pre-installed casing 14, but this is not essential. For example, the outer surface of the tubular 12 can be provided with a friction and/or sealing material to provide an anchor and seal in the annulus between the tubular 12 and the casing 14. Alternatively, spacers may be located in the annulus or cement used.

Use of the terms "above", "below", "upward" and "downward" herein are used with respect to the orientation of the apparatus shown in FIGS. 1 and 2. These terms should be construed accordingly where the apparatus is used in a lateral or deviated borehole. The terms "below" and "downward" generally refer to locations or directions that are nearer the formation or payzone.

It will be appreciated that the apparatus 10 can be used to expand the tubular 12 from the bottom-up by, reversing the direction of the apparatus 10 (e.g. turning it upside down with respect to the orientation of the apparatus in FIG. 1). However, it is advantageous to use the apparatus 10 to expand the tubular 12 from the top-down because the apparatus 10 can be retrieved easily and more quickly should its travel be arrested due to a protrusion or restriction in its path. This is because the portions of the tubular 12 that have not been expanded when the apparatus 10 becomes stuck will be below the apparatus 10, and thus it can be pulled out of the borehole relatively easily.

The cone 16 is typically located in the pre-expanded portion 12*e* as tubular 12 is lowered into the borehole, as shown in FIG. 1.

The cone 16 can be attached to a drill string, coiled tubing string or the like, but this is not generally required, as the pump 18 can be electric so that only an electrical cable to the pump 18 is required. Alternatively, the pump 18 may be hydraulically-driven and this generally requires a drill string or coiled tubing string for example through which fluids may be pumped (e.g. from the surface) to drive the pump 18 downhole.

The expansion process can therefore be autonomous where an electric pump and cable are used; that is once the pump 18 is actuated, there need be no further user intervention until the apparatus 10 is to be retrieved from the borehole (e.g. using a conventional fishing operation). However, a wireline or umbilical may be attached to the apparatus 10 to facilitate easy retrieval from the borehole should it become stuck, or once it has expanded the tubular 12.

Also, where the pump 18 is electrically-driven, no rig is required because a wireline, coiled tubing string or drill string is not required to propel the apparatus 10; only an electrical cable is required. This has significant advantages because the apparatus 10 can be used to repair damaged or washed-out liner by overlaying another liner on top and radially expanding this into place so that it straddles the damaged portion, without the need to use a rig. The apparatus 10 can also be used to install new casing, liner etc without the need for a rig.

The tubular 12 is optionally at least temporarily anchored at an end thereof during the expansion process. The tubular 12 can be anchored using any conventional means, such as a mechanical slip or a packer for example. Where the anchor is located at a lower end of the tubular 12, and expansion begins at the lower end, the tubular 12 will generally be in tension during the expansion process. This is also the case where the tubular 12 is anchored at the top and the expansion process is top-down. Where the anchor is located at an upper end of the tubular 12 and the expansion process is bottom-up, the tubular 12 will generally be in compression during the expansion process. Similarly, if the tubular 12 is anchored at a lower end and the expansion process is top-down, the tubular 12 will generally be in compression during expansion.

In certain embodiments, the apparatus 10 can include an inflatable device 28 (e.g. a packer) that is shown in phantom in FIGS. 1 and 2. The inflatable device 28 can be located in the pre-expanded portion 12*e* and then inflated at the required depth to provide a temporary anchor for the tubular 12 to the pre-installed casing 14. The inflatable device 28 can be releasably attached to the apparatus 10 so that once it has formed an anchor, it can be detached from the apparatus 10 and left in situ to be collected once the expansion process is completed (e.g. as the apparatus 10 is pulled out of hole). The inflation of the inflatable device 28 causes the pre-expanded portion 12*e* to be expanded further so that a portion thereof contacts the casing 14. Alternatively, or additionally, an outer surface of the tubular 12 can be provided with a friction and/or sealing material (e.g. rubber) that engages the casing 14 to provide a seal there between, and also to provide an anchor point for the subsequent expansion of the tubular 12.

The inflatable device 28 can also be used to provide a fluid chamber 30 in which fluid that is pumped from below the done 16 can collect. The build up of pressure in the chamber 30 and the lower pressure below the cone 16 causes the cone 16 to move downwards and thus expand the tubular. The inflatable device 28 provides a local seal for the fluid pressure above the cone 16 and would generally only be required until a sufficient portion of the tubular 12 has been expanded to provide a seal. The seal can be created by a metal-to-metal contact between the tubular 12 and the casing 14, but a friction and/or sealing material can be provided on the outer surface of the tubular 12 so that a seal is created when the tubular 12 is expanded. Once the tubular 12 has been expanded sufficiently to provide a seal, the inflatable device 28 is generally no longer required and can be deflated.

Where the inflatable device 28 is located within the pre-expanded portion 12*e*, as shown in FIG. 1, the inflatable device 28 can be used to expand the pre-expanded portion 12*e* (or portions thereof), as described above. The pre-expanded portion 12*e* can be provided with the friction and/or sealing material so that the material is energised upon inflation of the inflatable device to provide a local seal for the fluid pressure.

The inflatable device 28 can be telescopically attached to the expansion cone 16, and may be of any suitable configuration, but is typically a device that has an inflatable annular balloon-type portion that is mounted on an annular ring. The annular ring allows a string, wireline or the like to be passed through the inflatable device 28 as required, or in the embodiment shown, allows the shaft 20 and the electrical cable to the pump 18 (if required) to pass therethrough.

Where the expansion cone 16 is telescopically coupled to the inflatable device 28 using a telescopic coupling, the coupling typically comprises one or more telescopically coupled members that are attached to the inflatable device 28. As the expansion cone 28 moves downwards, the telescopic coupling extends a certain distance, say 10 feet (approximately 3 meters), at which point the telescopic member(s) are fully extended. At this point, the inflatable balloon-type portion of the inflatable device can be automatically deflated and further downward movement of the expansion cone 16 causes the inflatable device 28 also to move downward therewith.

It should be noted that the inflatable device 28 is no longer required to anchor the tubular 12 to the casing 14 as the expanded portion of tubular 12 secures it to the casing 14. A friction and/or sealing material (e.g. material 100, 122 as described below) can be used to enhance the grip of the tubular 12 on the casing 14 in use, and can also provide a seal in an annulus created between the tubular 12 and the casing 14.

Figures 3A, 3B, 3C:
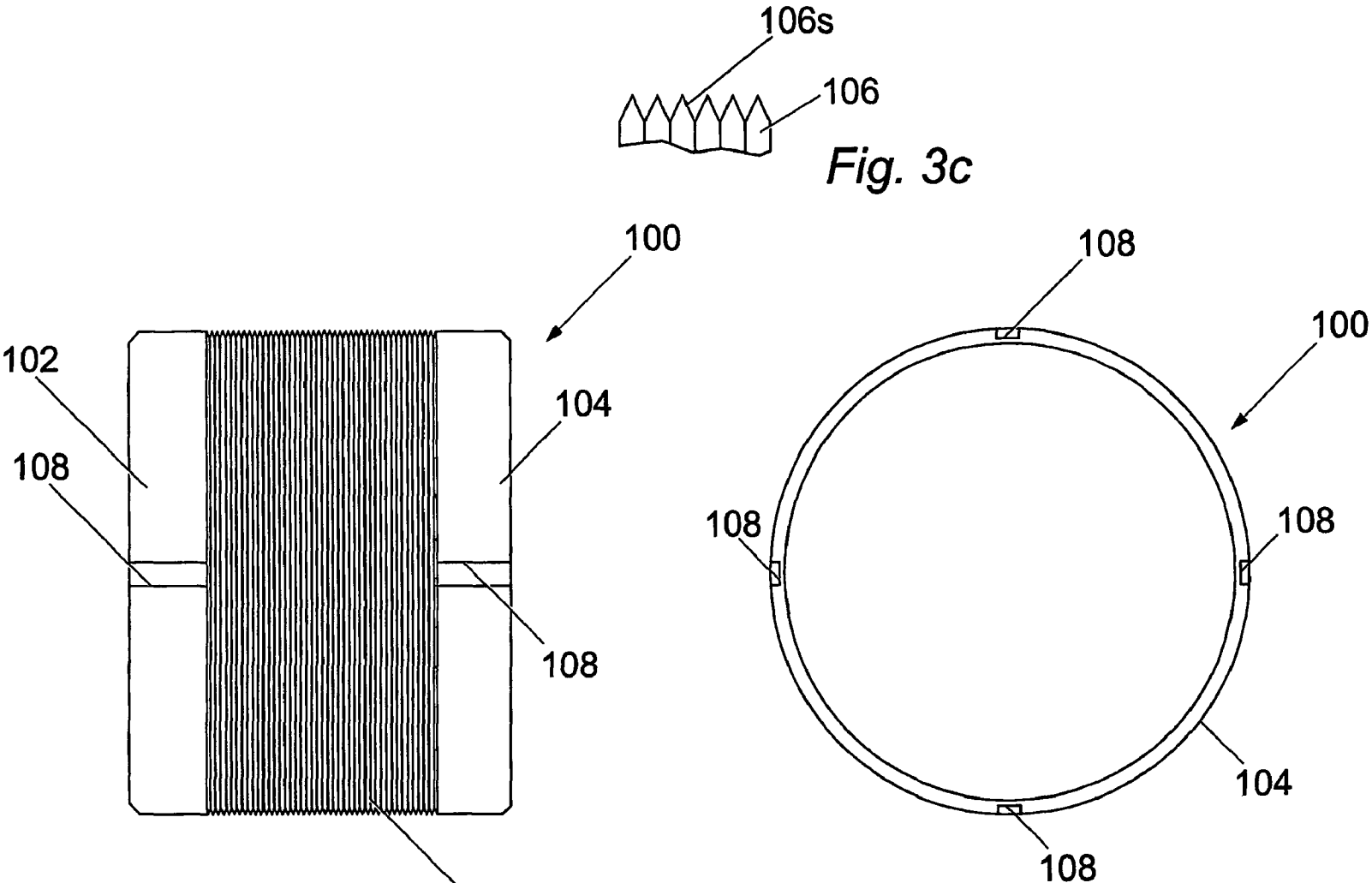
FIG. 3*a* is a front elevation showing a first configuration of a friction and/or sealing material that can be applied to an outer surface of a tubular.
FIG. 3*b* is an end elevation of the friction and/or sealing material of FIG. 3*a;*
FIG. 3*c* is an enlarged view of a portion of the material of FIGS. 3*a* and 3*b* showing a profiled outer surface.

Referring to FIGS. 3*a* to 3*c*, there is shown an exemplary configuration of a friction and/or sealing material 100 that can be applied to the outer surface of the tubular 12. The material 100 typically comprises first and second bands 102, 104 that are axially spaced-apart along a longitudinal axis of the tubular 12. The first and second bands 102, 104 are typically axially spaced by some distance, for example 5 inches (approximately 127 mm).

The first and second bands 102, 104 are preferably annular bands that extend circumferentially around the tubular 12, although this configuration is not essential. The first and second bands 102, 104 typically comprise 1 inch wide (approximately 25.4 mm) bands of a first type of rubber. The friction and/or sealing material 100 need not extend around the full circumference of the tubular 12.

Located between the first and second bands 102, 104 is a third band 106 of a second type of rubber. The third band 106 preferably extends between the first and second bands 102, 104 and is thus typically 3 inches (approximately 76 mm) wide.

The first and second bands 102, 104 are typically of a first depth. The third band 106 is typically of a second depth. The first depth is optionally larger than the second depth, although they can be the same, as shown in FIG. 3*a*. The first and second bands 102, 104 may protrude further from the surface of the tubular 12 than the third band 106, although this is not essential.

The first type of rubber (i.e. first and second bands 102, 104) is preferably of a harder consistency than the second type of rubber (i.e. third band 106). The first type of rubber is typically 90 durometer rubber, whereas the second type of rubber is typically 60 durometer rubber. Durometer is a conventional hardness scale for rubber.

The particular properties of the rubber may be of any suitable type and the hardnesses quoted are exemplary only. It should also be noted that the relative dimensions and spacings of the first, second and third bands 102, 104, 106 are exemplary only and may be of any suitable dimensions and spacing.

As can be seen from FIG. 3*c* in particular, an outer face 106*s* of the third band 106 can be profiled. The outer face 106*s* is ribbed to enhance the grip of the third band 106 on an inner face 12*i* of the casing 12. It will be appreciated that an outer surface on the first and second bands 102, 104 may also be profiled (e.g. ribbed). The material of the third band 106 can deform into the spaces between the ribs when it is compressed during expansion.

The two outer bands 102, 104 being of a harder rubber provide a relatively high temperature seal and a back-up seal to the relatively softer rubber of the third band 106. The third band 106 typically provides a lower temperature seal.

A number of portions 108 are provided in the first and second bands 102, 104. The portions 108 are of a reduced thickness in the lateral direction. The rubber of the first and second bands 102, 104 is relatively hard and thus tends not to stretch. The portions 108 of reduced thickness allow the material to stretch at these portions without breaking.

Figure 4B:
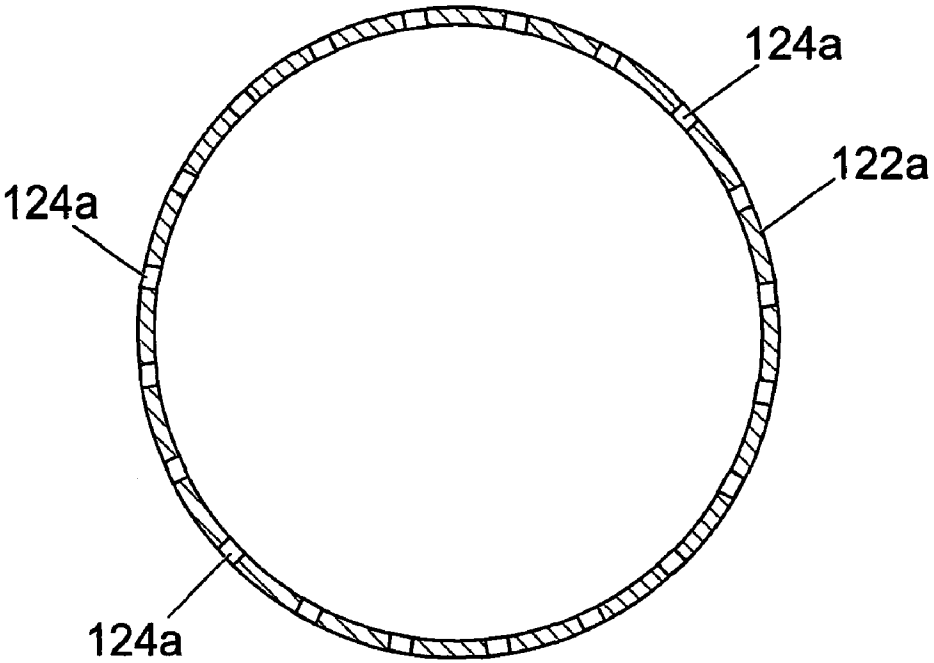
FIG. 4*b* is an end elevation of the friction and/or sealing material of FIG. 4*a*.
Figure 4A:
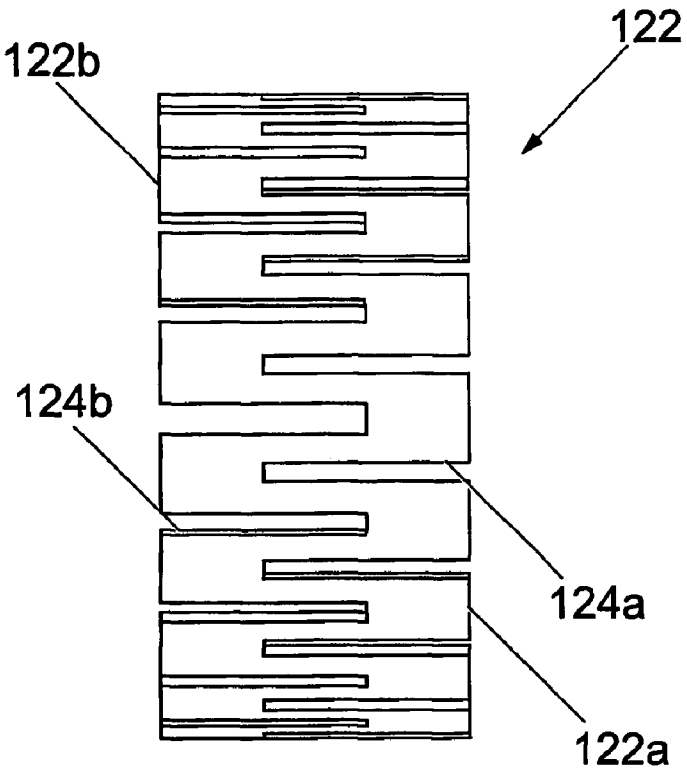
FIG. 4*a* is an front elevation of an alternative configuration of a friction and/or sealing material.

An alternative embodiment of a friction and/or sealing material 122 that can be applied to the outer surface of the tubular 12 is best shown in FIGS. 4*a* and 4*b*. The friction and/or sealing material 122 is in the form of a zigzag. In this embodiment, the friction and/or sealing material 122 comprises a single (preferably annular) band of rubber that is, for example, of 90 durometers hardness and is about 2.5 inches (approximately 28 mm) wide by around 0.12 inches (approximately 3 mm) deep.

To provide a zigzag pattern and hence increase the strength of the grip and/or seal that the material 122 provides in use, a number of slots 124*a*, 124*b* (e.g. 20) are milled into the band of rubber. The slots 124*a*, 124*b* are typically in the order of 0.2 inches (approximately 5 mm) wide by around 2 inches (approximately 50 mm) long.

To create the zigzag pattern, the slots 124*a* are milled at around 20 circumferentially spaced-apart locations, with around 18° between each along one edge 122*a* of the band. The process is then repeated by milling another 20 slots 124*b* on the other side 122*b* of the band, the slots 124*b* on side 122*b* being circumferentially offset by 9° from the slots 124*a* on the other side 122*a*.

As an alternative to having the inflatable device 28 telescopically coupled to the expansion cone, the tubular 12 can be provided with an expandable portion of casing or liner (not shown). The expandable portion may be located at an upper end 12*u* of the tubular 12 or may be integral therewith.

The inflatable device 28 is inflated to expand the inflatable annular balloon-type portion. As the balloon-type portion expands, the expandable portion of the tubular 12 also expands. The contact between the expandable portion and the casing 14 provides an anchor point and/or a seal between the tubular 12 (to which the expandable portion is attached or integral therewith) and the casing 14. Thus, the contact provides a seal for the fluid pressure that is used to force the expansion cone 16 through the tubular 12.

As the expansion cone 16 moves downward through the tubular 12 to radially expand it, the movement of the cone 16 is stopped after a predetermined time or distance, at which point the cone 16 can be retracted until a coupling between the expansion cone 16 and the inflatable device 28 latches. At this time, the inflatable annular balloon-type portion is automatically deflated and the apparatus 10 is actuated and begins to move downward. Movement of the expansion cone 16 causes the inflatable device 28 also to move downward. It should be noted that the downward movement of the expander device 16 should only be stopped once a sufficient length of tubular 12 has been expanded to provide a sufficient anchor.

It should also be noted that the expandable portion is no longer required to anchor the tubular 12 to the borehole as the portions of the tubular 12 that have been expanded by movement of the apparatus 10 secures the tubular 12 to the casing 14. The friction and/or sealing material (where used) can help to provide a reliable anchor for the tubular 12 whilst it is being expanded and also when in use.

As a further alternative, the inflatable device 28 can be releasably attached to the upper end 12*u* of the tubular 12 before the apparatus 10 is run into the borehole. The expansion cone 16 is located within the upper end 12*u* of the tubular 12, the upper end 12*u* being pre-expanded to accommodate the expansion cone 16. Similar to the previous embodiment, the inflatable device 28 has the expansion cone 16 releasably coupled thereto via a suitable coupling. Otherwise, the inflatable device 28 and the expansion cone 16 are substantially the same as the previous embodiments.

The inflatable device 28 is inflated to expand the inflatable annular balloon-type portion. As the balloon-type portion expands, it contacts the tubular 12, thus providing an anchor between the tubular 12 and the casing 14. This contact between the balloon-type portion and the casing 14 provides an anchor point and/or a seal between the tubular 12 and the casing 14. The seal is thus used to provide a sealed fluid chamber for movement of the apparatus 10.

It should be noted that in this embodiment, the forces applied to the tubular 12 by subsequent movement of it, that is by pushing or pulling on the tubular 12 for example, will be transferred to the casing 14 via the inflatable device 28. However, unlike conventional slips, the inflated balloon-type portion is less likely to damage the casing 14. Additionally, the size of the balloon-type portion can be chosen whereby it is sufficiently large so as not to lose its grip on the casing 14, even when the inflatable device 28 is moved upwardly or downwardly.

As the expansion cone 16 moves downwards through the tubular 12 to expand it, the movement thereof is stopped after a predetermined time or distance, at which point the expansion cone 16 is raised until the coupling between the expansion cone 16 and the inflatable device 28 latches. As with the previous embodiment, the inflatable balloon-type portion can be automatically deflated and further downward movement of the expansion cone 16 causes the inflatable device 28 also to move downward therewith. It should be noted that the downward movement of the expansion cone 16 should only be stopped once a sufficient length of tubular 12 has been expanded to provide a sufficient anchor.

The inflatable device 28 is not essential as a seal is created at the surface by the rams of a blow-out preventer (BOP) closing over the drill pipe, electrical cable or umbilical to provide a fluid chamber above the cone 16. However, a local seal can be provided (e.g. the inflatable device 28).

Referring now to FIG. 2, there is shown the apparatus 10 in use. It will be noted that the inflatable device has been inflated to fully expand the pre-expanded portion 12*e* into contact with the casing 14. The pre-expanded portion 12*e* is typically provided with a friction and/or sealing material (e.g. materials 100, 122 in FIGS. 3 and 4) so that a seal and/or anchor is created between the tubular 12 and the casing 14.

The pump 18 draws fluid from below the cone 16 to above it (as indicated by arrow 22), and the pressure differential across the cone 16 causes it to move downward and thereby radially expand the tubular 12.

It will be appreciated that the turbine 24 can be integral with the cone 16, or can be provided above or below it to draw fluids from above or below the cone 16 by way of the pump 18.

The apparatus 10 has the advantage that it avoids "squeeze" problems. Conventional top-down methods are generally hydraulic where fluid is pumped onto an upper face of the cone at pressure, forcing the cone to move downwards through the tubular to expand it. However, this causes the formation or payzone to be squeezed where movement of the cone downwardly in the conventional method forces the fluids therebelow back into the formation or payzone. This is because a borehole is typically a blind bore (i.e. it is closed at an end thereof that is typically near the formation or payzone). The fluids are thus forced into the formation or payzone and can cause significant damage and can possibly fracture the formation. The break up of the formation can seriously affect productivity therefrom and is thus undesirable.

The squeeze effect can also cause the cone to stop because the fluids below the cone may become trapped and thus a build up of pressure would occur beneath the cone. As the pressure below the cone increases, the hydraulic pressure above the cone that drives it through the tubular must also be increased.

However, the apparatus 10 draws fluids from below the cone 16 to above it and thus avoids the squeeze problems by removing the fluid below the cone. This is a significant advantage of the present invention.

It will be appreciated that the pressure differential across the cone 16 may be quite large, and will generally be sufficient to start expansion (i.e. provide sufficient force to move the expansion cone 16 downwards and thus expand the tubular 12). However, the reduction on pressure below the cone 16 is preferably kept to a minimum and will thus be relatively small. This is because it is undesirable for the pump 18 to draw up too much fluid because it is undesirable to draw fluids and sand etc from the formation or payzone.

Embodiments of the present invention thus provide advantages in that there is provided a method of expanding a tubular that works from the top down. This has advantages in that if the apparatus 10 becomes stuck due to restrictions or protrusions in its path, it is relatively simple to retrieve the apparatus 10 from the borehole. This is because the unexpanded portion of the tubular 12 is generally below the apparatus 10, and thus the restricted diameter of the unexpanded tubular does not make it difficult to pull the apparatus 10 out of the borehole.

Also, embodiments of the apparatus 10 draw fluids from below the cone 16 to above it, and thus avoid squeezing the formation or payzone, thus providing significant advantages over conventional top-down expansion methods.

Embodiments of the present invention also provide advantages in that less equipment is required. There is also no requirement to have a blind bore.

Modifications and improvements may be made to the foregoing without departing from the scope of the present invention.

The invention claimed is:

1. An apparatus for radially expanding a tubular member, the apparatus comprising:

an expander device; and a pump to drive the expander device, the pump being capable of moving with the expander device during an expansion of the tubular member.

2. The apparatus according to claim 1, wherein the pump is attached to the expander device.

3. The apparatus according to claim 1, wherein the pump is integral with the expander device.

4. The apparatus according to claim 3, wherein the expander device is provided with a longitudinal throughbore in which the pump is located.

5. The apparatus according to claim 1, wherein the pump creates a differential pressure across the expander device.

6. The apparatus according to claim 1, wherein the pump is axially fixed to the expander device.

7. The apparatus according to claim 6 wherein the pump is located inside the expander device.

8. The apparatus according to claim 1, wherein the expander device is an expansion cone.

9. An apparatus for radially expanding a tubular member, the apparatus comprising:

an expansion cone; and a driver device for the expansion cone, wherein the driver device creates a differential pressure across the expansion cone to urge movement of the expansion cone the driver device being capable of entering the tubular member and moving with the expander device during an expansion of the tubular member.

10. The apparatus according to claim 9, wherein the driver device is attached to the expansion cone.

11. The apparatus according to claim 9, wherein the driver device is integral with the expansion cone.

12. The apparatus according to claim 11, wherein the expansion cone is provided with a longitudinal throughbore in which the driver device is located.

13. The apparatus according to claim 12, wherein the driver device comprises a pump.

14. The apparatus according to claim 9, wherein the expansion cone is provided with a longitudinal throughbore in which the driver device is located.

15. The apparatus according to claim 14, wherein the driver device comprises a pump.

16. A method of radially expanding a tubular member, the method comprising the steps of:

locating an expansion cone and a pump in the tubular member;

actuating the pump to radially expand the tubular member; and moving the pump with the expansion cone during expansion of the tubular member.

17. The method according to claim 16, wherein the method includes the additional step of locating the tubular member in a second conduit.

18. The method according to claim 16, wherein the method includes the additional step of temporarily anchoring an end of the tubular member.

19. The method according to claim 16, wherein the step of actuating the pump comprises applying power to the pump.

20. The method according to claim 16, wherein the method includes the additional step of attaching the pump to the expansion cone.

21. The method according to claim 16, wherein the method includes the additional step of providing the pump integral with the expansion cone.

22. The method according to claim 16, wherein the method includes the additional step of creating a differential pressure across the expansion cone.

23. The method according to claim 22, wherein the method includes the additional step of drawing fluid from one side of the expansion cone to the other.

* * * * *